United States Patent [19]

Eriksson

[11] Patent Number: 4,586,665

[45] Date of Patent: May 6, 1986

[54] APPARATUS FOR TREATING CELLULOSE PULP WITH ADJUSTABLE TREATING GAP

[76] Inventor: Erik F. Eriksson, Ymsenvägen 9, S-121 42 Johanneshov, Sweden

[21] Appl. No.: 675,211

[22] Filed: Nov. 27, 1984

[30] Foreign Application Priority Data

Nov. 30, 1983 [SE] Sweden ..... 8306617

[51] Int. Cl.[4] ..... B21C 18/16; D21B 1/04; D21D 1/34

[52] U.S. Cl. ..... 241/259.2; 162/261; 241/260.1; 241/261

[58] Field of Search ..... 162/261; 241/260.1, 241/261, 259.1, 259.2, 259.3, 232; 308/429, 428, 438

[56] References Cited

U.S. PATENT DOCUMENTS

| | | | |
|---|---|---|---|
| 1,532,649 | 10/1922 | Bieber . | |
| 2,713,460 | 7/1955 | Atkinson | 241/232 |
| 4,154,408 | 5/1979 | Boling, Jr. | 241/232 |
| 4,168,806 | 9/1979 | Jakobs | 241/232 |
| 4,192,471 | 3/1980 | Beckman et al. | 241/232 |
| 4,214,947 | 7/1980 | Berger | 162/18 |
| 4,321,140 | 3/1982 | Luthi . | |
| 4,339,084 | 7/1982 | Eriksson | 241/261 |
| 4,393,983 | 7/1983 | Eriksson | 222/233 |

FOREIGN PATENT DOCUMENTS

| | | |
|---|---|---|
| 276453 | 8/1912 | Fed. Rep. of Germany . |
| 2905443 | 9/1979 | Fed. Rep. of Germany . |
| 2418295 | 6/1978 | France . |
| 7901002 | 11/1979 | PCT Int'l Appl. . |
| 7901001 | 11/1979 | PCT Int'l Appl. . |
| 417220 | 3/1981 | Sweden . |

*Primary Examiner*—S. Leon Bashore
*Assistant Examiner*—K. M. Hastings
*Attorney, Agent, or Firm*—Witherspoon & Hargest

[57] ABSTRACT

In an apparatus for treating cellulose pulp having a consistency above the flowage limit, the apparatus being provided with two shafts (1) rotating in the same axial plane and each carrying mutually intermeshing screws between which the pulp is treated during forward shift from an inlet (4) to an outlet (5) through a housing (3) enclosing the screws and supported by a mounting bed (25). The treating gap between the screws is adjustable due to the fact that the bearings (28) of at least one of the shafts (1) are supported on a cradle (29) having two end arms perpendicular to the shaft and mutually connected by a cross beam (35) extending in parallel to the shaft (1), the end arms (30) being journalled on the mounting bed (25) for swinging movement about journals (31) positioned on an axial line extending in parallel to shaft (1).

8 Claims, 3 Drawing Figures

APPARATUS FOR TREATING CELLULOSE PULP WITH ADJUSTABLE TREATING GAP

FIELD OF THE INVENTION

The present invention relates to an apparatus for treating cellulose pulp having a consistency above the flowage limit, the apparatus being provided with two shafts rotating in the same axial plane and each carrying mutually intermeshing means between which the pulp is treated during forward shift from an inlet to an outlet through a housing enclosing the treating means and supported by a mounting bed or surface.

DESCRIPTION OF THE PRIOR ART

In U.S. Pat. No. 4,339,084 there is described such an apparatus in which at least one of the screws is pivotally movable in relation to the other in such a way as to permit selective adjustment of the width of the treating gap between the mutually intermeshing screws and thereby selective control of the treating conditions to which the material is exposed. The swinging movement is obtained by pivotally supporting one of the bearings of the one shaft while the opposed bearing is adapted to be shifted in the common axial plane of the two shafts.

SUMMARY OF THE INVENTION

The known apparatus with angular adjustment of the one shaft in relation to the other does not permit any uniform adjustment of the depth of intermesh of the two screw threads over the whole length of the screw. This drawback is eliminated by the present invention due to the fact that at least one of the shafts is supported for swinging or rotating movement about an axial line in parallel to the shafts. During such a swinging movement the depth of engagement between the screw threads is increased or reduced uniformly over the whole length of the screws. The characteristic features of the invention appear from the attached claims.

BRIEF DESCRIPTION OF THE DRAWINGS

The invention will be explained in detail in connection with a practical embodiment shown in the attached drawings in which.

DESCRIPTION OF THE PREFERRED EMBODIMENT

In a broad sense the apparatus includes first and second spaced shafts rotatable in the same axial plane, each of the shafts carrying means positioned in a housing for working the pulp from a housing inlet to a housing outlet in a working zone located between the shafts. The apparatus includes at least a first bearing member for supporting the first shaft and at least a second bearing member for supporting the second shaft. Means are positioned upon a mounting surface for supporting the first bearing member including at least one support member extending from the first bearing member to the surface. Means are also positioned upon the mounting surface for supporting the second bearing member including at least one other support member extending from the second bearing member to the surface. Each of the support members of at least one of the bearing members includes means for permitting such support members to rotate or swing to vary the spacing between the shafts to vary the dimensions of the working zone. Means are also provided to rotate such support members.

Preferably, the apparatus includes a set of bearings for supporting the first shaft including a first bearing engaging one end of the first shaft and a second bearing engaging the other end of the first shaft. Also included is another set of bearings for supporting the second shaft including a third bearing engaging one end of the second shaft and a fourth bearing engaging the other end of the second shaft. Means are provided positioned upon a mounting surface for supporting the bearings of one of the sets of bearings including a first support member extending from the first bearing to the surface and a second support member extending from the second bearing to the surface. Means are also positioned upon the mounting surface for supporting the bearings of the other set of bearings including a third support member extending from the third bearing to the surface and a fourth support member extending from the fourth bearing to the surface. Each of the support members of at least one of the sets of bearings includes a first arm and a second arm, one end of the first arm engaging the bearing and one end of the second arm engaging the surface. The bearings of this set of bearings are connected together at their respective first arms by a cross beam. Means are provided connecting the first and second arms of this set of bearings for permitting the first and second arms to rotate relative to each other to vary the spacing between the shafts to vary the dimensions of the working zone, and means are connected to the beam for rotating the arms relative to each other.

Figure 1:
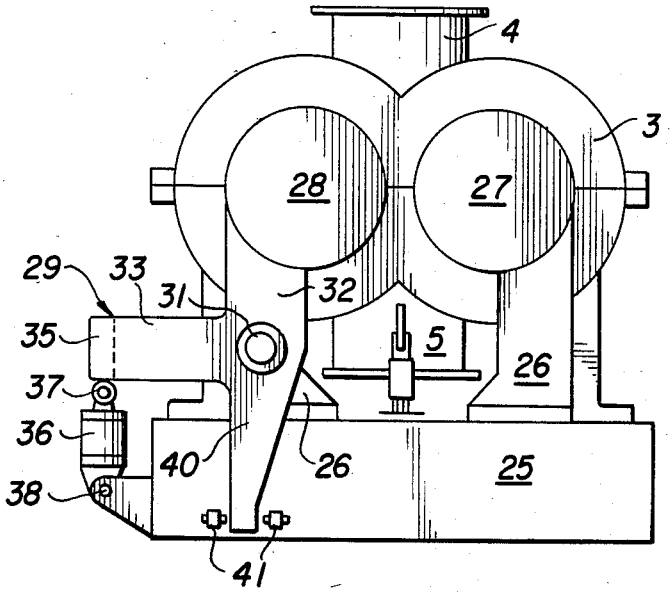
FIG. 1 is an end view of an apparatus constructed in accordance with the invention.
Figure 2:
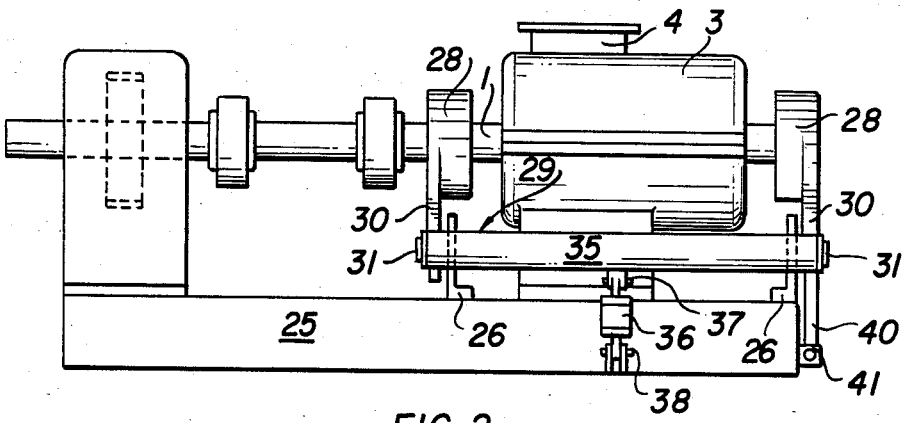
FIG. 2 is an elevation of the apparatus of FIG. 1.
Figure 3:
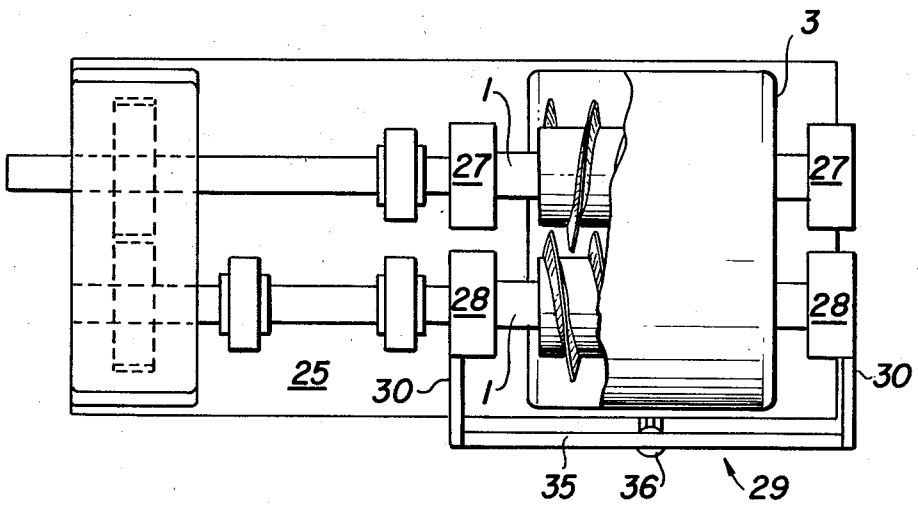
FIG. 3 is a partially cut away plan view of the apparatus of FIG. 2.

In the preferred embodiment, the drawings depict an apparatus for treating cellulose pulp, the essential parts of this apparatus being two shafts 1 rotatably supported in the same axial plane and surrounded by a housing 3 having an inlet 4 at the upper side close to the left end wall as shown in FIG. 2 and an outlet 5 on the lower side close to the opposite end wall. A mounting bed 25 carries schematically shown upright bearing supports 26 for supporting the bearings 28 of shaft 1 and 27 of the other shaft.

While the bearings 27 of said other shaft are stationarily supported on the mounting bed 25, the bearings 28 of shaft 1 are swingably supported by a cradle 29 permitting an adjustment of the spacing between the shafts by parallel shift of shaft 1. The cradle 29 itself comprises two end arms or supports which are pivotally journalled at 31 in the bearing supports or arms 26 at a position below the part of housing 3 in which shaft 1 operates. On each end arm 30 a portion 32 extends in a upward direction from the journal 31 to carry one of the bearings 28 of shaft 1. Approximately at right angles to the portion 32 carrying the bearing 28 and on the same level as the journal 31 the end arm 30 comprises a horizontal portion 33. The two horizontal portions 33 extending from journals 31 on either end arm 30 are mutually connected by a cross beam 35. The cradle formed by cross beam 35 and end arms 30 as well as the bearings 28 carried by the portions 32 forms a stiff unit that may be swung about the common axial line of journals 31. A hydraulic or pneumatic adjusting device 36 is at its one end pivotally connected to the lower side of cross beam 35 by a pivotal bearing 37 and at the other end to the mounting bed 25 by a pivotal bearing 38. During respectively extension and retraction of the moving part of the pneumatic or hydraulic device 36 the unit comprising the cradle 29, bearings 28 and the shaft 1 carried by the bearings will be swung respectively towards and away from the other shaft for adjustment of the working distance between the screw threads carried by the shafts.

Obviously, it is important to prevent excessive swinging movements of shaft 1 to avoid contact between the screw threads carried by shaft 1 and the screw threads carried by the other shaft or with the housing. For this reason the end arm 30 at the right-hand end of the housing as seen in FIG. 2 is extended in a downward direction from the journal 31 by a portion 40 the free end of which is positioned between adjustable abutments 41 for limiting the amplitude of the swinging movement of the cradle.

As the amplitude of swinging movement is rather small, it is sufficient that the passage openings for shaft 1 in the end arms of housing 3 are widened to a corresponding extent and sealed by gaskets (not shown) which are resilient or adapted to be shifted in the swinging direction of the shaft.

Of course, both shafts may be pivotally supported in the way described above.

The above described way of supporting one of the shafts not only permits the adjustments described above but in addition offers a certain protection against damage that may be caused when hard objects, such as screws, accidentally carried by the pulp are introduced into the treating gap between the mutually intermeshing screws. In such a case the swingable shaft may be temporarily pressed away from the stationary shaft within the limits permitted by abutments 41.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What I claim is:

1. Apparatus for treating cellulose pulp having a consistency above the flowage limit, comprising first and second spaced shafts rotatable in the same axial plane, each of said shafts carrying mutually intermeshing means positioned in a housing and cooperating for working said pulp during passage thereof from a housing inlet positioned at one end of the shafts to a housing outlet positioned at an opposite end of the shafts in a working zone located between said ends and said shafts, said apparatus further comprising:

a set of bearings for supporting said first shaft including a first bearing engaging one end of said first shaft and a second bearing engaging the other end of said first shaft;

another set of bearings for supporting said second shaft including a third bearing engaging one end of said second shaft and a fourth bearing engaging the other end of said second shaft;

means positioned upon a mounting support surface for supporting the bearings of one of said sets of bearings including a first support member extending from said first bearing to said support surface and a second support member extending from said second bearing to said support surface;

means positioned upon said mounting support surface for supporting the bearings of the other of said sets of bearings including a third support member extending from said third bearing to said support surface and a fourth support member extending from said fourth bearing to said support surface;

each of the said two support members of at least one of said sets of bearings including a first arm and a second arm, one end of said first arm engaging said bearing and one end of said second arm engaging said support surface;

the bearings of said at least one of said sets of bearings being connected together at their respective first arms by a cross beam;

means connecting said first arms and second arms of said at least one of said sets of bearings for permitting said first arms and second arms to rotate parallel relative to each other to vary the spacing between said shafts to vary the dimensions of said working zone; and, means connected to said beam for rotating said first arms and second arms relative to each other so that both ends of at least one of said shafts are supported for rotating about an axial line in parallel to said shafts to uniformly vary the depth of engagement between said mutually intermeshing means over the whole length of said mutually intermeshing means.

2. Apparatus of claim 1 wherein said cross beam is parallel to said shafts.

3. Apparatus of claim 1 wherein said rotating means includes a fluid actuated member having a first end pivotally connected to said beam and a second end pivotally connected to said support surface.

4. Apparatus of claim 2 wherein said rotating means includes a fluid actuated member having a first end pivotally connected to said beam and a second end pivotally connected to said support surface.

5. Apparatus of claim 1 including means for limiting said rotation.

6. Apparatus of claim 3 including means for limiting said rotation.

7. Apparatus of claim 5 wherein said limiting means includes a pair of adjustable abutments connected to said support surface and wherein at least one of said first arms includes an extending portion having an end positioned between said abutments.

8. Apparatus of claim 6 wherein said limiting means includes a pair of adjustable abutments connected to said support surface and wherein at least one of said first arms includes an extending portion having an end positioned between said abutments.

* * * * *